US010211513B2

(12) United States Patent
Nozawa

(10) Patent No.: US 10,211,513 B2
(45) Date of Patent: Feb. 19, 2019

(54) INFORMATION COMMUNICATION DEVICE AND ANTENNA

(71) Applicant: Sony Computer Entertainment Inc., Tokyo (JP)

(72) Inventor: Tetsufumi Nozawa, Chiba (JP)

(73) Assignee: Sony Interactive Entertainment Inc., Tokyo (JP)

( * ) Notice: Subject to any disclaimer, the term of this patent is extended or adjusted under 35 U.S.C. 154(b) by 62 days.

(21) Appl. No.: 14/390,433

(22) PCT Filed: Apr. 1, 2013

(86) PCT No.: PCT/JP2013/059952

§ 371 (c)(1),
(2) Date: Oct. 3, 2014

(87) PCT Pub. No.: WO2013/153985

PCT Pub. Date: Oct. 17, 2013

(65) Prior Publication Data

US 2015/0042518 A1 Feb. 12, 2015

(30) Foreign Application Priority Data

Apr. 13, 2012 (JP) ..... 2012-092501

(51) Int. Cl.
*H01Q 1/24* (2006.01)
*H01Q 13/10* (2006.01)
(Continued)

(52) U.S. Cl.
CPC ..... *H01Q 1/243* (2013.01); *H01Q 1/2266* (2013.01); *H01Q 1/24* (2013.01); *H01Q 9/0414* (2013.01);
(Continued)

(58) Field of Classification Search
CPC ..... H01C 1/243; H01C 1/24; H01C 13/10; H01C 13/16; H01C 21/24
(Continued)

(56) References Cited

U.S. PATENT DOCUMENTS 6,847,329 B2 1/2005 Ikegaya
9,048,531 B2 6/2015 Nozawa
(Continued)

FOREIGN PATENT DOCUMENTS

CN 2891317 Y 4/2007
CN 201210515 Y 3/2009
(Continued)

OTHER PUBLICATIONS

International Preliminary Report on Patentability and Written Opinion for corresponding Application PCT/JP2013/059952, dated Oct. 23, 2014.
(Continued)

*Primary Examiner* — Dieu H Duong
(74) *Attorney, Agent, or Firm* — Matthew B. Dernier, Esq.

(57) ABSTRACT

To provide an information communication device including an antenna that can singly transmit and receive both of vertically polarized waves and horizontally polarized waves with a sufficient strength. The information communication device includes a casing and the antenna disposed within the casing. The antenna includes a plate-shaped planar portion having a feeding point. The planar portion includes a conductive portion extending in a direction of obliquely intersecting a bottom surface of the casing, and a ground portion connected to one end of the conductive portion.

12 Claims, 5 Drawing Sheets

(51) Int. Cl.

| | |
|---|---|
| ***H01Q 21/24*** | (2006.01) |
| ***H01Q 9/04*** | (2006.01) |
| ***H01Q 1/22*** | (2006.01) |
| ***H01Q 13/16*** | (2006.01) |

(52) U.S. Cl.
CPC ..... *H01Q 13/10* (2013.01); *H01Q 13/16* (2013.01); *H01Q 21/24* (2013.01)

(58) Field of Classification Search
USPC ..... 343/702, 700 MS
See application file for complete search history.

(56) References Cited

U.S. PATENT DOCUMENTS

| | | | | |
|---|---|---|---|---|
| 2004/0008146 | A1 | 1/2004 | Ikegaya | |
| 2009/0021430 | A1 | 1/2009 | Isogai | |
| 2009/0040110 | A1* | 2/2009 | Chien | H01Q 5/371 343/700 MS |
| 2009/0273524 | A1 | 11/2009 | Furuya | |
| 2010/0079351 | A1* | 4/2010 | Huang | H01Q 1/48 343/846 |
| 2010/0156746 | A1* | 6/2010 | Yung | H01Q 1/243 343/860 |
| 2010/0253582 | A1 | 10/2010 | Nozawa | |

FOREIGN PATENT DOCUMENTS

| | | | |
|---|---|---|---|
| CN | 101859922 | A | 10/2010 |
| JP | 2004-048119 | A | 2/2004 |
| JP | 2010-259048 | A | 11/2010 |

OTHER PUBLICATIONS

Office Action for corresponding Chinese Patent Application No. 201380017926.5 dated Jun. 23, 2015.
International Search Report for corresponding Application PCT/JP2013/059952, dated May 21, 2013.
European Search report for corresponding EP Patent Application No. 13775238.2, pp. 1-9, dated Sep. 17, 2015.

* cited by examiner

INFORMATION COMMUNICATION DEVICE AND ANTENNA

TECHNICAL FIELD

The present invention relates to an information communication device that transmits and receives information by radio signal, and an antenna used in the information communication device.

BACKGROUND ART

There are information communication devices that perform radio communication on the basis of standards such as a Bluetooth (registered trademark) standard, an IEEE 802.11 standard, and the like. Such an information communication device may be required to transmit and receive polarized waves in various directions with a certain strength or more. For example, in a case where the information communication device is a game machine for home use, the information communication device needs to perform radio communication to and from various kinds of peripheral devices that can transmit and receive main polarized waves in different directions, such as a controller of the game machine whose antenna is disposed in a horizontal direction, a headset whose antenna is disposed in a vertical direction, and the like. Accordingly, as one type of such an information communication device, an information communication device that transmits and receives radio signals by a polarization diversity system has been proposed (see for example PTL 1). The information communication device of the polarization diversity system has two antennas corresponding to vertically polarized waves and horizontally polarized waves, respectively. Therefore, both of the vertically polarized waves and the horizontally polarized waves can be transmitted and received with a sufficient strength.

CITATION LIST

Patent Literature

[PTL 1]
U.S. Patent Application Publication No. 2009/0021430

SUMMARY

It is an object of the present invention to provide an antenna that can singly transmit and receive both of vertically polarized waves and horizontally polarized waves with a sufficient strength, and an information communication device including the antenna.

An information communication device according to the present invention is an information communication device including a casing and an antenna disposed within the casing, wherein the antenna includes a plate-shaped planar portion having a feeding point, and the planar portion includes a conductive portion extending in a direction of obliquely intersecting a bottom surface of the casing, and a ground portion connected to one end of the conductive portion.

In addition, an antenna according to the present invention includes a plate-shaped planar portion having a feeding point, and the planar portion includes a conductive portion extending in a direction of obliquely intersecting a horizontal plane, and a ground portion connected to one end of the conductive portion.

DESCRIPTION OF EMBODIMENT

An embodiment of the present invention will hereinafter be described in detail with reference to the drawings.

Figure 1A:
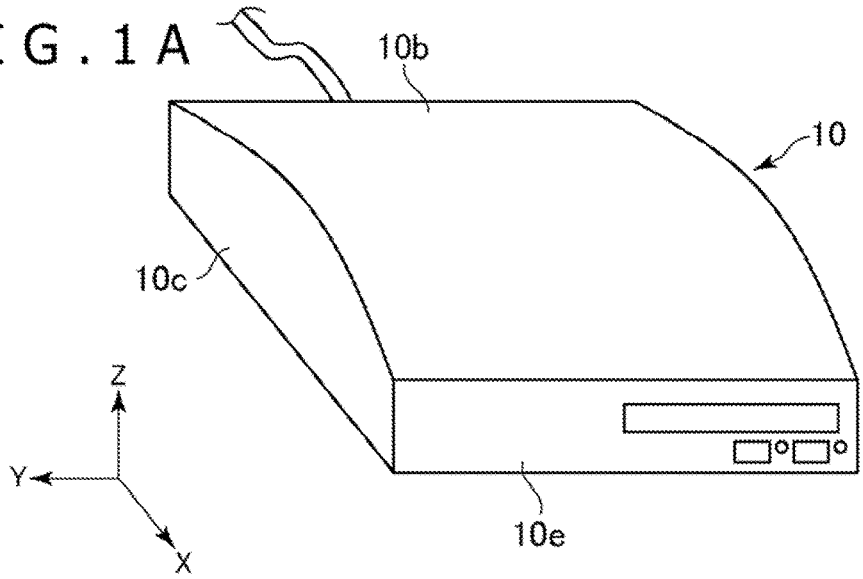
FIG. 1A is an external view showing a state in which an information communication device according to an embodiment of the present invention is placed horizontally.
Figure 1B:
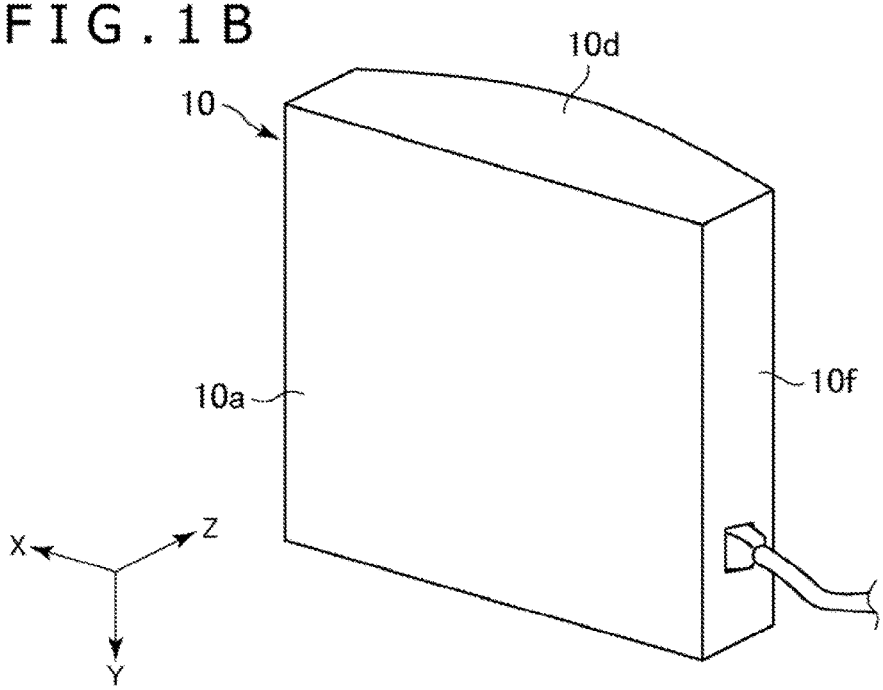
FIG. 1B is an external view showing a state in which the information communication device according to the embodiment of the present invention is placed vertically.

An information communication device 1 according to one embodiment of the present invention is for example a game machine for home use, a personal computer, or the like. As shown in FIG. 1A and FIG. 1B, the information communication device 1 has a casing 10 in a thin box shape. The information communication device 1 transmits and receives information to and from an external device such as a peripheral device or the like by radio communication. Incidentally, suppose in the present embodiment that the information communication device 1 supports each of a radio communication based on the Bluetooth standard and a radio communication based on the IEEE 802.11 standard.

The casing 10 is constituted mainly of six external surfaces. In the following, of these external surfaces, one of the two surfaces having a largest area will be referred to as a first bottom surface 10*a*, and the other surface opposed to the first bottom surface 10*a* will be referred to as a first top surface 10*b*. The other four external surfaces are side surfaces intersecting both of the first bottom surface 10*a* and the first top surface 10*b*. In the following, one of the side surfaces will be referred to as a second bottom surface 10*c*. In addition, a surface opposed to the second bottom surface 10*c* will be referred to as a second top surface 10*d*, and one of the two remaining external surfaces will be referred to as a front surface 10*e* and the other will be referred to as a back surface 10*f*. Further, in the following, as shown in FIG. 1A and FIG. 1B, a direction that is parallel with the first bottom surface 10*a* and which goes from the back surface 10*f* to the front surface 10*e* will be set as an X-axis positive direction, a direction that is parallel with the first bottom surface 10*a* and which goes from the second top surface 10*d* to the second bottom surface 10*c* will be set as a Y-axis positive direction, and a direction that is parallel with the second bottom surface 10*c* (perpendicular to the first bottom surface 10*a*) and which goes from the first bottom surface 10*a* to the first top surface 10*b* will be set as a Z-axis positive direction. That is, the first bottom surface 10*a* is a surface parallel with an XY plane, and the second bottom surface 10*c* is a surface parallel with a ZX plane.

The casing 10 of the information communication device 1 is formed such that each of the first bottom surface 10*a* and the second bottom surface 10*c* can be placed as a bottom surface (surface facing a floor surface). That is, as shown in FIG. 1A, the casing 10 may be usable in a state of being placed with the first bottom surface 10*a* facing downward (horizontal placement), or as shown in FIG. 1B, the casing 10 may be usable in a state of being placed with the second bottom surface 10*c* facing downward (vertical placement). Incidentally, when the casing 10 is placed with the second bottom surface 10*c* having a smaller area than the first bottom surface 10*a* facing downward, the casing 10 may be placed so as to be supported on a support (stand) rather than being placed directly on the floor surface.

In addition, the information communication device 1 is normally placed such that the front surface 10*e* faces in the direction of a user. Therefore, the front surface 10*e* may be provided with an indicator for indicating operation states of the device, a switch used by the user relatively frequently, and the like. In addition, the back surface 10*f* may be provided with connectors for connecting various kinds of cables such as a power cable and the like. Thus providing a presenting section for presenting various kinds of information to the user, an operating section for receiving operations by the user, and connectors in the external surfaces other than the first bottom surface 10*a* and the second bottom surface 10*c* enables the information communication device 1 to be used regardless of which of the first bottom surface 10*a* and the second bottom surface 10*c* faces downward when the casing 10 is placed.

Figure 2:
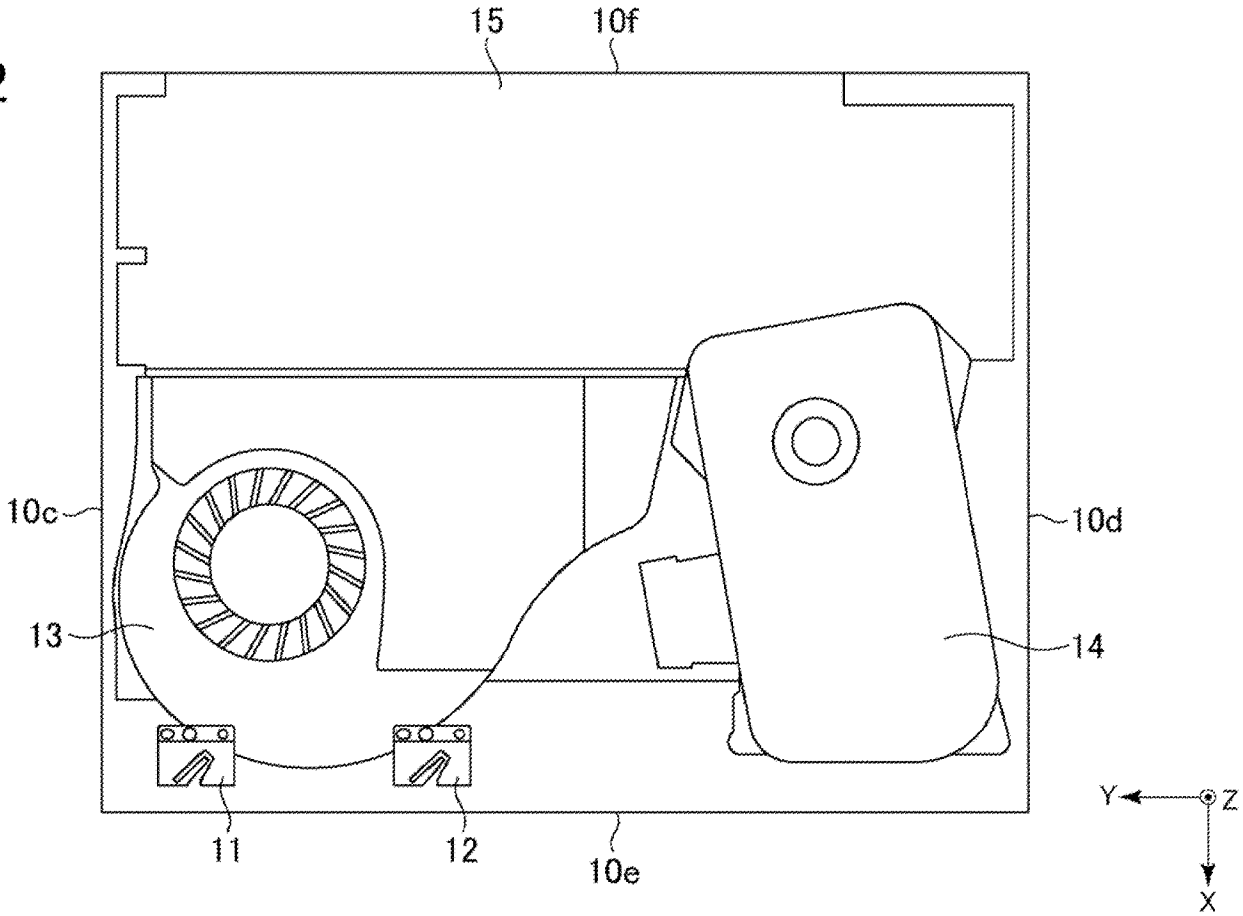
FIG. 2 is a plan view of an inside of a casing of the information communication device according to the embodiment of the present invention.

FIG. 2 is a plan view of an inside of the casing 10. As shown in the figure, a first antenna 11, a second antenna 12, a cooling fan 13, an optical disk drive 14, and a power supply unit 15 are arranged within the casing 10. The first antenna 11 in this case is an antenna used for a radio communication according to the Bluetooth standard. The second antenna 12 is an antenna used for a radio communication according to the IEEE 802.11 standard. As shown in the figure, the first antenna 11 and the second antenna 12 are disposed in the vicinity of the front surface 10*e* of the casing 10 (that is, on a side closer to the front surface 10*e* than the structures such as the cooling fan 13, the power supply unit 15, and the like). Thus, a radio signal emitted from the first antenna 11 and the second antenna 12 to the side of the front surface 10*e* propagates in a direction in which the user is assumed to be present, without being obstructed by the cooling fan 13 or the like. In addition, at least a part of the radio signal emitted to the side of the back surface 10*f* is reflected by the cooling fan 13 and the like, and also propagates to the side of the front surface 10*e*. Incidentally, the first antenna 11 and the second antenna 12 in the present embodiment are fixed to the cooling fan 13, as will be described later.

Figure 3:
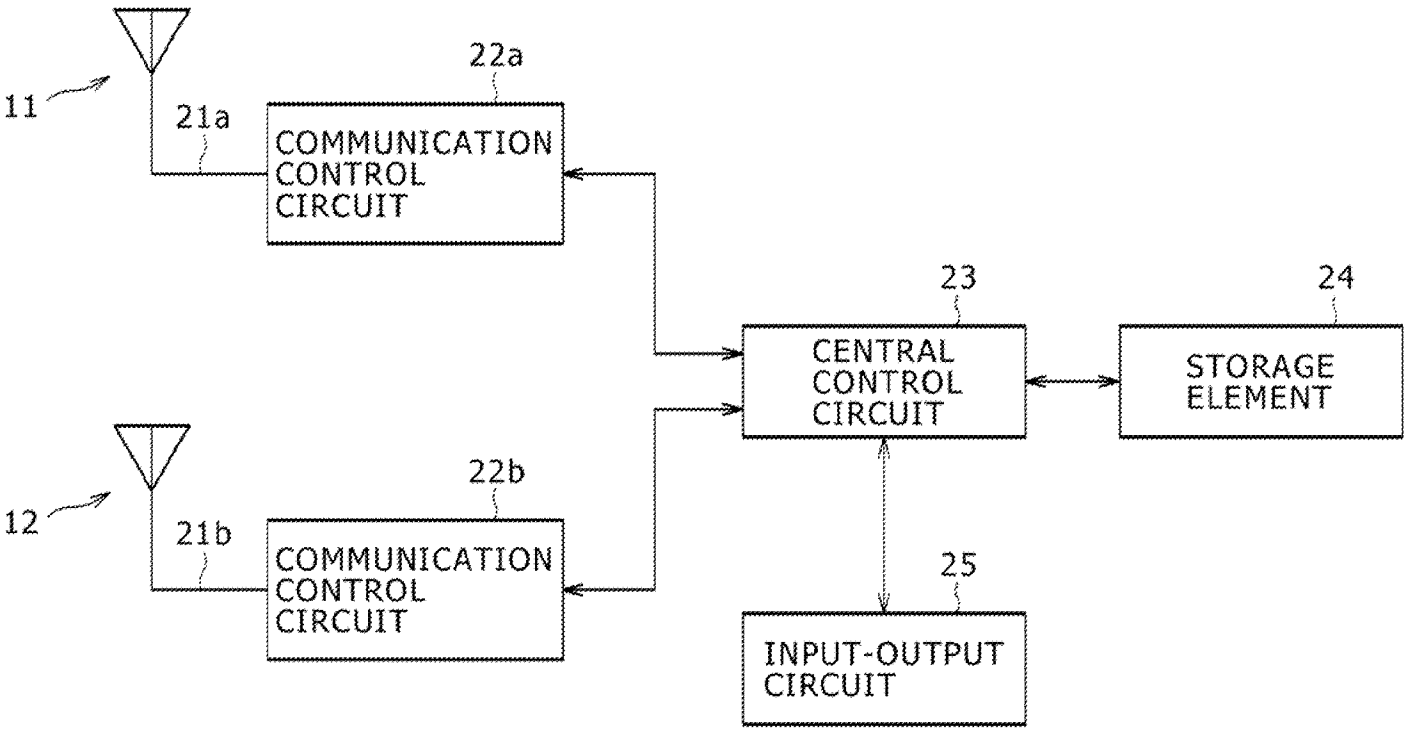
FIG. 3 is a constitution block diagram showing a general configuration of a circuit implemented in the information communication device according to the embodiment of the present invention.

FIG. 3 is a configuration block diagram showing a general configuration of a circuit implemented in the information communication device 1 according to the present embodiment. As shown in the figure, the first antenna 11 is connected to a communication control circuit 22*a* via a feeder 21*a*. Similarly, the second antenna 12 is connected to a communication control circuit 22*b* via a feeder 21*b*. In addition, the communication control circuits 22*a* and 22*b* are both connected to a central control circuit 23. The central control circuit 23 is further connected to a storage element 24 and an input-output circuit 25.

The communication control circuits 22*a* and 22*b* control radio communication by performing signal processing according to the radio communication standards supported by the communication control circuits 22*a* and 22*b*, respectively. Specifically, the communication control circuits 22*a* and 22*b* each feed power to the corresponding first antenna 11 or the corresponding second antenna 12 via the feeder 21*a* or 21*b*. Then, when the input of information as an object of transmission is received from the central control circuit 23, the information is modulated, and thereby a modulated signal is obtained. The communication control circuits 22*a* and 22*b* supply the modulated signal to the corresponding antennas to make the modulated signal emitted by radio. In addition, signals arriving at the corresponding antennas are received, and the received signals are demodulated and then output to the central control circuit 23. Incidentally, the communication control circuits 22*a* and 22*b* may be implemented by a single integrated circuit.

The central control circuit 23 is a program control device such as a CPU or the like. The central control circuit 23 operates according to a program stored in the storage element 24. When the central control circuit 23 receives an instruction to transmit information to an external device connected by radio communication according to the program stored in the storage element 24, the central control circuit 23 outputs the information to be transmitted to the communication control circuit 22*a* or 22*b*. In addition, the central control circuit 23 receives the input of information received by the communication control circuits 22*a* and 22*b*, and performs processing using the information.

The storage element 24 includes a RAM (Random Access Memory), a ROM (Read Only Memory), and the like. The storage element 24 stores the program copied from a recording medium or the like not shown in the figure. The storage element 24 also operates as a work memory that retains information used for the processing of the central control circuit 23.

The input-output circuit 25 is connected to the central control circuit 23 and a display (including a television for home use) or the like as an external input-output device. The input-output circuit 25 outputs a video signal to the display or the like according to an instruction input from the central control circuit 23.

In the information communication device 1 according to the present embodiment, for example the central control circuit 23 executes a program such as a game program or the like. Then, information indicating details of an operation by the user is received from a game controller as an external device by radio communication based on the Bluetooth standard. In addition, an audio signal is transmitted to an audio reproducing device such as a headset, headphones, or the like by radio communication based on the Bluetooth standard. Further, the information communication device 1 sends and receives information to and from another information communication device by radio communication based on the IEEE 802.11 standard.

The game controller generally has a horizontally long shape so as to be easily operated by the user in a state of being held with both hands of the user. Hence, an antenna included in the game controller is disposed along a horizontal direction to the ground, and radio signals transmitted and received by the antenna are horizontally polarized waves. On the other hand, in a case of a headset or the like, an antenna is disposed along a perpendicular direction to the ground, and radio signals transmitted and received by the antenna are vertically polarized waves. In the present embodiment, shapes and positions within the casing 10 of the first antenna 11 and the second antenna 12, respectively, are determined so that radio signals of polarized waves in such various directions can be transmitted and received with a sufficient strength. Incidentally, the Bluetooth standard and the IEEE 802.11 standard use a same 2.4-GHz band as a frequency band. The first antenna 11 and the second antenna 12 therefore have shapes substantially identical to each other. Accordingly, in the following, the first antenna 11 will be taken as an example, and the shape thereof will be described in detail.

Figure 4:
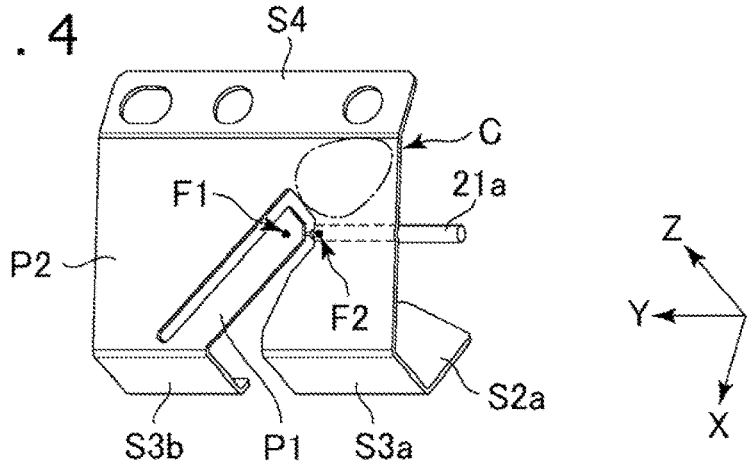
FIG. 4 is a perspective view showing a shape of an antenna included in the information communication device according to the embodiment of the present invention.
Figure 5:
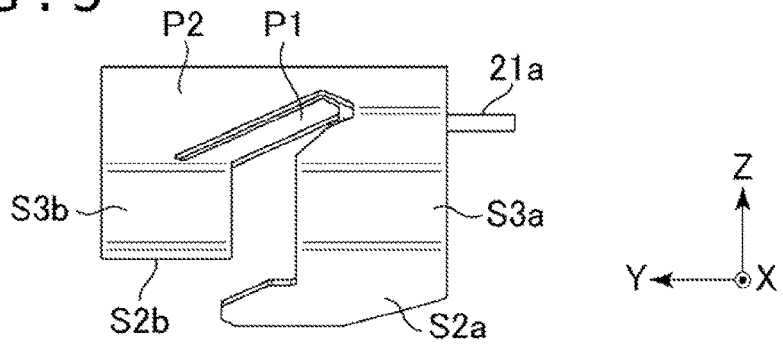
FIG. 5 is a front view of the antenna.
Figure 6:
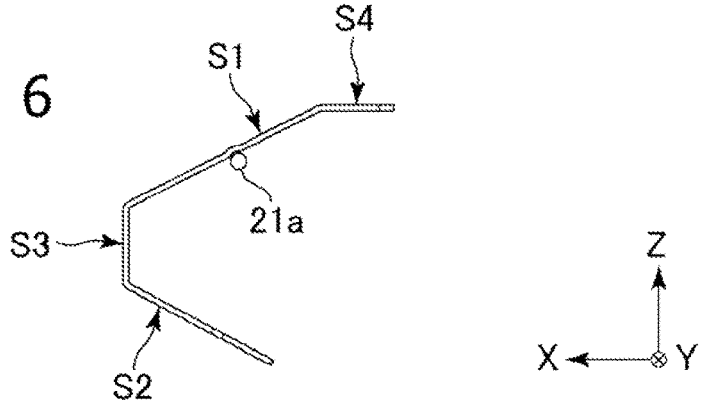
FIG. 6 is a right side view of the antenna.
Figure 7:
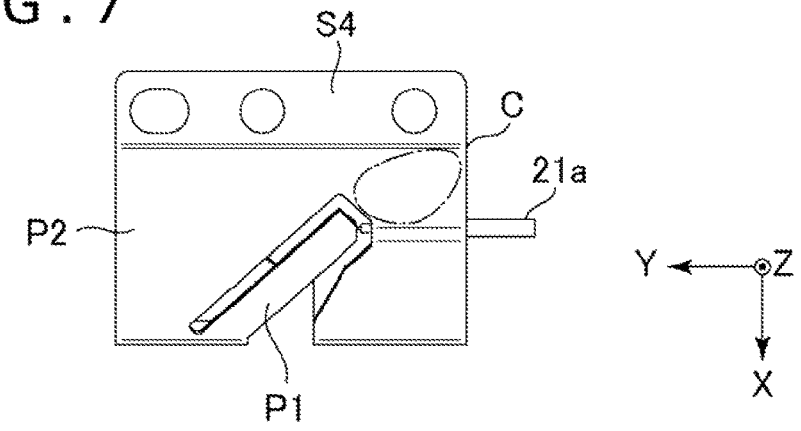
FIG. 7 is a plan view of the antenna.
Figure 8:
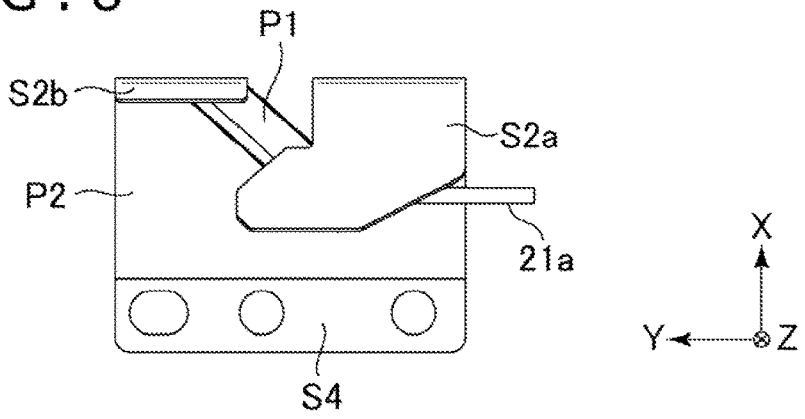
FIG. 8 is a bottom view of the antenna.
Figure 9:
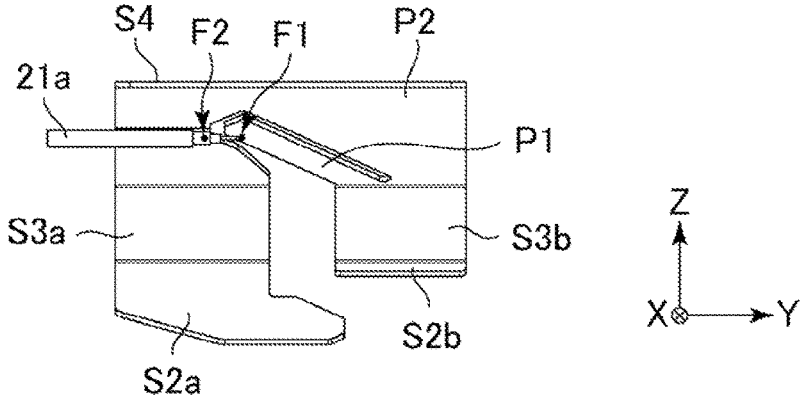
FIG. 9 is a rear view of the antenna.

FIG. 4 is a perspective view of an external appearance of the first antenna 11. FIG. 5 is a front view of the first antenna 11 as viewed from the front. FIG. 6 is a right side view of the first antenna 11 as viewed from the right side surface. In addition, FIG. 7 is a plan view of the first antenna 11 as viewed from above. FIG. 8 is a bottom view of the first antenna 11 as viewed from below. FIG. 9 is a rear view of the first antenna 11 as viewed from the rear. Incidentally, in this case, the front of the first antenna 11 is on the side of the front surface 10*e* of the casing 10 (Y-axis negative direction side) in a state in which the first antenna 11 is disposed within the casing 10 as shown in FIG. 2.

The first antenna 11 is formed by a radiation plate formed by working one plate-shaped metal. Specifically, the first antenna 11 as a whole has a shape formed by bending, at three positions, a substantially rectangular metallic plate provided with a slit extending in a vertical direction at a center thereof. As shown in FIG. 6, the first antenna 11 therefore includes four plate-shaped planar portions: a first slope portion S1 located upward as viewed from the front side; a second slope portion S2 located downward; a front portion S3 that connects the first slope portion S1 and the second slope portion S2 to each other; and a top portion S4 connected to the first slope portion S1. An upper end of the first slope portion S1 is connected to an end edge on a front side (X-axis positive direction side) of the top portion S4 so as to form an obtuse angle on a lower side (Z-axis negative direction side). In addition, a lower end of the first slope portion S1 is connected to an upper end of the front portion S3 to form an obtuse angle on a back side (X-axis negative direction side), and an upper end of the second slope portion S2 is connected to a lower end of the front portion S3 to form an obtuse angle on the back side (X-axis negative direction side).

As shown in FIG. 2, the first antenna 11 is disposed within the casing 10. Thus, the top portion S4 is parallel to the first bottom surface 10*a* of the casing 10, and the front portion S3 is parallel to the front surface 10*e* and the back surface 10*f* of the casing 10. On the other hand, the first slope portion S1 and the second slope portion S2 obliquely intersect the first bottom surface 10*a*, which is a surface facing the floor surface (horizontal plane) when the casing 10 is placed in an orientation as shown in FIG. 1A. In addition, the first slope portion S1 and the second slope portion S2 are inclined in opposite directions from each other with respect to the first bottom surface 10*a*, and are oriented in directions that intersect each other so as to form an acute angle with the front portion S3 interposed between the first slope portion S1 and the second slope portion S2.

In the present embodiment, the feeder 21*a* is a coaxial cable, and a feeding point to which the feeder 21*a* is connected is located on the back side of the first slope portion S1. Specifically, a conductive portion P1 and a ground portion P2 are formed within the first slope portion S1. An inner conductor of the feeder 21*a* is connected to a connection point F1 of the conductive portion P1, and an outer conductor of the feeder 21*a* is connected to a connection point F2 of the ground portion P2.

The first slope portion S1 has a substantially rectangular shape provided with an elongate C-shaped slit on an inside thereof. The conductive portion P1 has an elongate rod-like shape formed so as to be separated from other parts by the C-shaped slit. The conductive portion P1 extends, within the first slope portion S1, along a direction between the Y-axis negative direction and the Z-axis positive direction as viewed from the front side. More specifically, the conductive portion P1 extends obliquely in a direction of an upper right from a base end of the conductive portion P1 which the base end is at a position slightly to the left at a lower end of the first slope portion S1 as viewed from the front side. The connection point F1 is disposed in a tip end portion of the conductive portion P1. In addition, the conductive portion P1 is connected at the base end portion thereof to the ground portion P2. The frequencies of radio signals to be transmitted and received by the first antenna 11 are determined so as to be in the 2.4-GHz band, mainly by a length and a shape of the conductive portion P1.

In the present embodiment, the first antenna 11 is disposed such that the conductive portion P1 extends in an oblique direction with respect to the horizontal plane regardless of which of the first bottom surface 10*a* and the second bottom surface 10*c* faces downward when the casing 10 is placed. Specifically, the whole of the first slope portion S1 including the conductive portion P1 obliquely intersects the first bottom surface 10*a*. Thus, of course, the conductive portion P1 also extends in a direction of obliquely intersecting the first bottom surface 10*a*. In addition, the first slope portion S1 itself is disposed substantially perpendicularly with respect to the second bottom surface 10*c*. However, the conductive portion P1 is obliquely disposed within the first slope portion S1. The conductive portion P1 therefore extends in an oblique direction with respect to the second bottom surface 10*c*. Because the conductive portion P1 thus extends in an oblique direction with respect to either of the first bottom surface 10*a* and the second bottom surface 10*c*, the first antenna 11 can be provided with such an emission characteristic as to emit both of vertically polarized waves and horizontally polarized waves regardless of in which of the orientations of the vertical placement and the horizontal placement the casing 10 is placed. Incidentally, the inclination of the extending direction of the conductive portion P1 with respect to the horizontal plane is preferably in a range of 30 degrees to 60 degrees.

In addition, the ground portion P2 is formed by a portion of the first slope portion S1 excluding the conductive portion P1, and is disposed so as to surround the conductive portion P1. Here, the conductive portion P1 extends in an oblique direction within the substantially rectangular first slope portion S1, and the tip end portion of the conductive portion P1 is oriented toward one corner of the first slope portion S1 (specifically an upper right corner C as viewed from the front). By thus disposing the conductive portion P1, it is possible to widen a region of the ground portion P2 which region is located in a direction in which the conductive portion P1 is further extended from the tip end portion where the connection point F1 is located while securing a necessary length of the conductive portion P1. The region is located between the connection point F1 and the corner C, and is enclosed by alternate long and short dashed lines in FIG. 4 and FIG. 7. Because a relatively high current flows through this portion, a sufficient radio field intensity can be obtained while the first antenna 11 as a whole is made relatively small.

The front portion S3 is divided into a left part and a right part as viewed from the front side, and is formed by two rectangular portions S3a and S3b. Incidentally, a slit that divides the front portion S3 into the left part and the right part is formed so as to be continuous with the C-shaped slit that forms the conductive portion P1 within the first slope portion S1. An upper end of the rectangular portion S3a is connected to a right side portion of the ground portion P2. An upper end of the rectangular portion S3b is connected to a left side portion of the ground portion P2 and a base end portion of the conductive portion P1.

The second slope portion S2 is formed by two left and right parts as viewed from the front side, and is formed by a reversed L-shaped portion S2a on the right side and a rectangular portion S2b on the left side. An upper end of the reversed L-shaped portion S2a is connected to a lower end of the rectangular portion S3a, and extends downward in a reversed L-shape as viewed from the front side. In addition, a lower left portion of the reversed L-shaped portion S2a as viewed from the front side is obliquely cut away. An upper end of the rectangular portion S2b is connected to a lower end of the rectangular portion S3b. The width of the rectangular portion S2b coincides with the width of the rectangular portion S3b. The length of the rectangular portion S2b is considerably shorter than that of the rectangular portion S2a. The second slope portion S2 functions as a director, which acts to strengthen polarized waves in the upward-downward direction of the first antenna 11 (that is, the Y-axis direction).

The top portion S4 has a rectangular shape whose width is the same as that of the first slope portion S1, and is provided with three through holes therein. The first antenna 11 is fixed to the casing 10 by screwing the first antenna 11 to the cooling fan 13 via one of the through holes in a state in which positioning projections provided at an end portion of the cooling fan 13 are inserted in the other two through holes. Thus fixing the top portion S4 to a structure within the casing 10 (cooling fan 13 in this case) can prevent a main body portion of the first antenna 11 (that is, a portion formed by the first slope portion S1, the front portion S3, and the second slope portion S2) from coming into contact with the casing 10 or other members within the casing 10, and thus prevent the shape of the first antenna 11 as a whole from being distorted.

According to the information communication device 1 according to the present embodiment, the first antenna 11 and the second antenna 12 are disposed such that the conductive portion P1 in which the feeding point is present obliquely intersects the horizontal plane in both of the case where the casing 10 is placed vertically and the case where the casing 10 is placed horizontally. Both of the first antenna 11 and the second antenna 12 can thereby transmit and receive a radio signal with a practically sufficient strength regardless of whether the casing 10 is placed vertically or whether the casing 10 is placed horizontally and regardless of which of vertically polarized waves and horizontally polarized waves a device at the other end of communication uses as main polarized waves.

The invention claimed is:

1. An information communication device comprising:

a casing having a plurality of side surfaces laying substantially parallel to respective planes in an X, Y, Z Cartesian Coordinate System, the plurality of surfaces including a front surface parallel to the Y-Z plane, a first surface parallel to the X-Y plane, and a second surface parallel to the X-Z plane; and an antenna disposed within the casing, wherein the antenna includes a plate-shaped planar portion having an elongate conductive portion extending longitudinally in a direction of extension that obliquely intersects both the first surface and the second surface of the casing, and a ground portion connected to one end of the conductive portion, wherein the elongate conductive portion emits both vertically polarized waves and horizontally polarized waves.

2. The information communication device according to claim 1, wherein the antenna is fed by a coaxial cable, the conductive portion is connected to an inner conductor of the coaxial cable, and the ground portion is connected to an outer conductor of the coaxial cable.

3. The information communication device according to claim 2, wherein other end portion of the conductive portion being on an opposite side from the one end portion connected to the ground portion is connected to the inner conductor.

4. The information communication device according to claim 1, wherein the planar portion has a rectangular shape, and the other end portion of the conductive portion being on an opposite side from the one end portion connected to the ground portion extends in a direction toward one corner of the planar portion.

5. The information communication device according to claim 1, wherein the antenna is disposed within the casing such that the planar portion obliquely intersects the first surface of the casing.

6. The information communication device according to claim 5, wherein the antenna further includes a second planar portion, the second planar portion being connected to the planar portion having the feeding point, and obliquely intersecting the casing in an opposite direction from the planar portion.

7. The information communication device according to claim 1, wherein the casing is formed so as to be placeable on either of the first surface and the second surface as a downward facing surface facing a floor surface, and the antenna is disposed within the casing such that the conductive portion also obliquely intersects the one side surface.

8. An antenna, comprising:

a plate-shaped planar portion having an elongate conductive portion extending longitudinally in a direction of extension that obliquely intersects both a first reference plane and a second reference plane, and a ground portion connected to one end of the conductive portion, wherein the elongate conductive portion emits both vertically polarized waves and horizontally polarized waves, wherein the first reference plane and the second reference plane are oriented substantially parallel to respective planes in an X, Y, Z Cartesian Coordinate System, where the first reference plane is parallel to the X-Y plane, and the second reference plane is parallel to the X-Z plane, such that the direction of extension of the elongate conductive portion obliquely intersects the X-Y plane and the X-Z plane, and is not parallel to any of the respective planes of the X, Y, Z, Cartesian Coordinate System.

9. The antenna according to claim 8, wherein the antenna is fed by a coaxial cable, the conductive portion is connected to an inner conductor of the coaxial cable, and the ground portion is connected to an outer conductor of the coaxial cable.

10. The antenna according to claim 9, wherein other end portion of the conductive portion being on an opposite side from the one end portion connected to the ground portion is connected to the inner conductor.

11. The antenna according to claim 8, wherein the planar portion has a rectangular shape, and the other end portion of the conductive portion being on an opposite side from the one end portion connected to the ground portion extends in a direction toward one corner of the planar portion.

12. The antenna according to claim 8, further comprising a second planar portion connected to the planar portion having a feeding point, and oriented in a direction of intersecting the planar portion so as to form an acute angle with the planar portion.

* * * * *